US005601664A

United States Patent [19]

Kosa et al.

[11] Patent Number: 5,601,664

[45] Date of Patent: Feb. 11, 1997

[54] CORROSION-RESISTANT MAGNETIC MATERIAL

[75] Inventors: Theodore Kosa, Reading; Stephen M. Lukes, North Douglassville; Douglas W. Dietrich, Wernersville; Terry A. DeBold, Wyomissing, all of Pa.

[73] Assignee: CRS Holdings, Inc., Wilmington, Del.

[21] Appl. No.: 555,508

[22] Filed: Nov. 8, 1995

Related U.S. Application Data

[63] Continuation of Ser. No. 321,229, Oct. 11, 1994, abandoned.

[51] Int. Cl.[6] ..... C22C 38/18

[52] U.S. Cl. ..... 148/325; 148/307; 420/42; 420/69

[58] Field of Search ..... 148/307, 325; 420/42, 69

[56] References Cited

U.S. PATENT DOCUMENTS

| | | | |
|---|---|---|---|
| 2,897,078 | 7/1959 | Nishikiori | 420/42 |
| 3,615,367 | 10/1971 | Tanczyn | 420/42 |
| 3,713,812 | 1/1973 | Brickner et al. | 420/69 |
| 3,926,685 | 12/1975 | Gueussier et al. . | |
| 4,059,440 | 11/1977 | Takemura et al. . | |
| 4,264,356 | 4/1981 | Shinagawa et al. . | |
| 4,360,381 | 11/1982 | Tarutani et al. . | |
| 4,465,525 | 8/1984 | Yoshimura et al. . | |
| 4,477,280 | 10/1984 | Shiga et al. . | |
| 4,652,428 | 3/1987 | Maruhasi et al. | 420/42 |
| 4,726,853 | 2/1988 | Gressin et al. . | |
| 4,799,972 | 1/1989 | Masuyama et al. . | |
| 4,957,701 | 9/1990 | Masuyama et al. | 420/69 |
| 4,969,963 | 11/1990 | Honkura et al. | 148/307 |
| 5,069,870 | 12/1991 | Iseda et al. | 420/70 |
| 5,110,544 | 5/1992 | Sato et al. | 420/69 |
| 5,190,722 | 3/1993 | Saito et al. | 420/40 |
| 5,202,088 | 4/1993 | Genma et al. | 420/40 |
| 5,302,214 | 4/1994 | Uematsu et al. | 148/325 |

FOREIGN PATENT DOCUMENTS

| | | |
|---|---|---|
| 0422574 | 4/1991 | European Pat. Off. . |
| 0435003 | 7/1991 | European Pat. Off. . |
| 57-54252 | 3/1982 | Japan . |
| 1519313 | 7/1978 | United Kingdom . |

OTHER PUBLICATIONS

Cubberly et al., Corrosion–Resistant Steel Casings, in *Metals Handbook,* Ninth Ed., vol. 3, pp. 94–97. 1980.

Kiessling and Rohlin, Scand. J. Metallurgy, 6:56–58 (1977).

Kiessling, R., Influence of Sulfide Composition on the Machinability and Corrosion Properties of a Resulfurized Ferritic 18:2 Steel, in Int. Symposium on Influence of metallurgy on Machinability of Steel, Sep. 26–28, 1977, Tokyo, Japan, pp. 253–261.

Patent Abstracts of Japan, vol. 016 No. 304 (C–0959), 6 Jul. 1992 & JP,A,04 083857 (Sanyo Special Steel Co. Ltd.) 17 Mar. 1992.

*Primary Examiner*—John Sheehan

*Attorney, Agent, or Firm*—Dann, Dorfman, Herrell and Skillman, P.C.

[57] ABSTRACT

A ferritic, stainless steel alloy containing in weight percent about 0.05% max. C, 2.0% max. Mn, 0.70–1.5% Si, 0.1–0.5% S, 15–20% Or, 0.80–3.00% Mo, 0.10–1.0% Nb, 0.06% max. N, and the balance iron and impurities, provides a unique combination of magnetic properties, corrosion resistance, and machinability.

12 Claims, No Drawings

CORROSION-RESISTANT MAGNETIC MATERIAL

This application is a continuation of U.S. application Ser. No. 08/321,229, filed Oct. 11, 1994, now abandoned.

FIELD OF THE INVENTION

This invention relates to a free-machining, corrosion resistant, ferritic steel alloy, and more particularly to such an alloy and an article made therefrom having a novel combination of magnetic and electrical properties and corrosion resistance in a chloride-containing environment.

BACKGROUND OF THE INVENTION

A ferritic stainless steel designated as Type 430F has been used in magnetic devices such as cores, end plugs, and housings for solenoid valves. A commercially available composition of Type 430F alloy contains, in weight percent 0.065% max. C, 0.80% max. Mn, 0.30–0.70% Si, 0.03% max. P, 0.25–0.40% S, 17.25–18.25% Cr, 0.60% max. Ni, 0.50% max. Mo, and the balance is essentially Fe. Type 430F alloy provides a good combination of magnetic properties, machinability, and corrosion resistance. Although Type 430F alloy provides good corrosion resistance in such mild environments as air having relatively high humidity, fresh water, foodstuffs, nitric acid, and dairy products, the alloy's ability to resist corrosion in chloride-containing environments leaves much to be desired.

Type 430FR alloy is a ferritic stainless steel that is similar in composition to Type 430F alloy except for higher silicon, i.e., 1.00–1.50% Si. Type 430FR alloy provides higher electrical resistivity and higher annealed hardness than Type 430F alloy. However, Type 430FR provides corrosion resistance that is about the same as Type 430F alloy.

A need has arisen for a soft magnetic, easily machinable alloy that provides better corrosion resistance in chloride-containing environments than either Type 430F alloy or Type 430FR alloy. Although it is known that molybdenum benefits the corrosion resistance of some stainless steels, e.g., the so-called 18Cr-2Mo steel alloy, in chloride-containing environments, it has been found that the addition of molybdenum alone to a ferritic stainless steel such as Type 430F or 430FR, does not consistently provide the desired level of corrosion resistance in such an environment. Accordingly, it would be desirable to have a soft magnetic, free-machining, ferritic alloy that also provides consistently good resistance to corrosion in a chloride-containing environment.

SUMMARY OF THE INVENTION

The problems associated with the known soft magnetic, free-machining, corrosion resistant ferritic alloys are solved to a large degree by the alloy according to the present invention. As summarized in the table below, a ferritic, corrosion resistant alloy in accordance with the present invention has the following broad, intermediate, and preferred compositions, in weight percent.

| | Broad | Intermediate | Preferred |
|---|---|---|---|
| C | 0.05 max. | 0.03 max. | 0.020 max. |
| Mn | 2.0 max. | 0.1–1.0 | 0.2–0.6 |
| Si | 0.70–1.5 | 0.90–1.4 | 1.00–1.2 |
| S | 0.1–0.5 | 0.2–0.4 | 0.25–0.35 |

-continued

| | Broad | Intermediate | Preferred |
|---|---|---|---|
| Cr | 15–20 | 16–19 | 17–18 |
| Mo | 0.80–3.00 | 1.00–2.50 | 1.50–2.00 |
| Nb | 0.10–1.0 | 0.20–0.60 | 0.30–0.40 |
| N | 0.06 max. | 0.05 max. | 0.030 max. |

The balance of the alloy is essentially iron except for the usual impurities found in commercial grades of such steels and small amounts of other elements retained from refining additions. Such elements may be present in amounts varying from a few thousandths of a percent up to larger amounts, provided however, that the amounts of any such impurities and additional elements present in the alloy are controlled so as not to adversely affect the basic and novel properties of this alloy. Within their respective weight percent ranges the elements C, Nb, and N are balanced such that the ratio Nb/(C+N) is about 7–12. Here and throughout this application, percent (%) means percent by weight unless otherwise indicated.

The foregoing tabulation is provided as a convenient summary and is not intended to restrict the lower and upper values of the weight percent ranges of the individual elements of the alloy of this invention for use solely in combination with each other, or to restrict the broad, intermediate, or preferred ranges of the elements for use solely with each other. Thus, one or more of the broad, intermediate, or preferred element ranges can by used with one or more of the other ranges for the remaining elements. In addition, a broad, intermediate, or preferred minimum or maximum for an element can be used with the maximum or minimum for that element from one of the remaining ranges.

DETAILED DESCRIPTION

The alloy according to the present invention contains at least about 15%, better yet at least about 16%, and preferably at least about 17% chromium because chromium benefits the corrosion resistance of this alloy. Chromium also contributes to increasing the electrical resistivity provided by this alloy. Increased electrical resistivity is desirable for reducing eddy currents in electromagnetic components that are subjected to alternating magnetic flux. Too much chromium adversely affects the magnetic saturation induction thereby reducing the magnetic performance of magnetic induction cores made from this alloy. Accordingly, chromium is limited to not more than about 20%, better yet to not more than about 19%, and preferably to not more than about 18%.

Molybdenum also benefits the corrosion resistance of this alloy, particularly its resistance to crevice corrosion and pitting in a chloride containing environment. To obtain the benefit to corrosion resistance provided by molybdenum, the alloy contains at least about 0.80%, better yet at least about 1.00%, and preferably at least about 1.50% molybdenum. Molybdenum is beneficial also because it stabilizes ferrite in this alloy.

Too much molybdenum adversely affects the magnetic saturation induction of the alloy. Further, molybdenum and chromium form one or more phases, such as carbides, in the alloy structure that adversely affect the corrosion resistance of this alloy. Thus, this alloy contains not more than about 3.00%, better yet, not more than about 2.50% molybdenum. For best results, the alloy contains not more than about 2.00% molybdenum.

At least about 0.10%, better yet at least about 0.20%, and preferably at least about 0.30% niobium is present in this alloy because niobium contributes to the pitting resistance of this alloy, for example, in the presence of chlorides. The inventors of the alloy according to the present invention have found that corrosion resistance in a chloride-containing environment is significantly enhanced when niobium and molybdenum are present together in this alloy. Niobium helps to stabilize carbon and/or nitrogen in this alloy, thereby benefitting the intergranular corrosion resistance provided by the alloy. Niobium also benefits the weld ductility and corrosion resistance of the present alloy when autogenously welded.

Too much niobium adversely affects the workability of this alloy. Accordingly, the alloy contains not more than about 1.0%, better yet not more than about 0.60%, and preferably not more than about 0.40% niobium.

Silicon is present in this alloy because it contributes to stabilization of ferrite, thereby ensuring an essentially ferritic structure. More specifically, silicon raises the $A_{c1}$ temperature of the alloy such that during annealing of the alloy, the formation of austenite and martensite is essentially inhibited, thereby permitting desirable grain growth which benefits the magnetic properties of this alloy. Silicon also increases the electrical resistivity of this alloy and its annealed hardness. For these reasons, the alloy contains at least about. 0.70 or 0.80%, better yet at least about 0.90%, and preferably at least about 1.00% silicon.

Too much silicon adversely affects the workability of this alloy. Accordingly, not more than about 1.5%, better yet not more than about 1.4%, and preferably not more than about 1.2% silicon is present in this alloy.

At least about 0.1%, better yet at least about 0.2%, and preferably at least about 0.25% sulfur is present in this alloy because it benefits the machinability of the alloy. Too much sulfur adversely affects the corrosion resistance and workability of this alloy. Therefore, sulfur is restricted to not more than about 0.5%, better yet to not more than about 0.4%, and preferably to not more than about 0.35% in this alloy.

Up to about 0.1% selenium can be present in this alloy because it benefits sulfide shape control in the alloy. When the benefits provided by selenium are not required, the amount of selenium is restricted to not more than about 0.01%, preferably not more than about 0.005%.

A small amount of manganese can be present in this alloy, and preferably at least about 0.1%, better yet at least about 0.2%, manganese is present. When present, manganese benefits the hot workability of this alloy and combines with some of the sulfur to form sulfides that contain manganese and/or chromium. Such sulfides benefit the machinability of the alloy. The presence of too much manganese in those sulfides adversely affects the corrosion resistance of this alloy, however. Moreover, manganese is an austenite former and too much manganese adversely affects the magnetic properties of the alloy. Therefore, not more than about 2.0%, better yet not more than about 1.0%, and preferably not more than about 0.6%, manganese is present in this alloy.

Carbon and nitrogen are considered to be impurities in the present alloy and are kept as low as practicable to avoid the adverse effect of those elements on such magnetic properties as permeability and coercive force. When too much carbon and nitrogen are present in this alloy, the $A_{c1}$ temperature of the alloy is undesirably low and precipitates such as carbides, nitrides, or carbonitrides form in the alloy. Such precipitates pin the grain boundaries, thereby undesirably retarding grain growth when the alloy is annealed. Furthermore, the presence of too much carbon and nitrogen adversely affects the intergranular corrosion resistance of this alloy. To avoid such problems, the amount of carbon present in this alloy is restricted to not more than about 0.05%, better yet to not more than about 0.03%, and preferably to not more than about 0.020% and the amount of nitrogen is restricted to not more than about 0.06%, better yet to not more than about 0.05%, and preferably to not more than about 0.030%.

The balance of this alloy is essentially iron except for the usual impurities found in commercial grades of alloys for the same or similar service or use and other elements that may be present in small amounts retained from additions made for refining this alloy during the melting process. The levels of such impurities and retained elements are controlled so as not to adversely affect the desired properties of this alloy. In this regard, the alloy contains not more than about 0.035%, preferably not more than about 0.020%, phosphorus; not more than about 0.05%, preferably not more than about 0.005% aluminum; not more than about 0.02%, preferably not more than about 0.01%, titanium; and not more than about 0.004%, preferably not more than about 0.002%, calcium. Furthermore, this alloy contains not more than about 0.60%, preferably not more than about 0.40%, nickel; not more than about 0.25%, preferably not more than about 0.15%, copper; not more than about 0.25%, preferably not more than about 0.15%, vanadium; and not more than about 0.005%, preferably not more than about 0.001%, boron. Moreover, this alloy contains not more than about 0.01%, preferably not more than about 0.005%, tellurium and not more than about 0.005%, preferably not more than about 0.001% lead.

The alloy of this invention does not require any unusual preparation and can be made using well known techniques. The preferred commercial practice is to melt the alloy in an electric arc furnace and refine the molten alloy by the argon-oxygen decarburization (AOD) process. This alloy can also be made by powder metallurgy techniques.

The alloy is preferably hot-worked from about 1950° F. (1065° C.) to about 1600° F. (870° C.). This alloy can be heat treated by annealing for at least about 1–4 hours at a temperature in the range of 1472°–2012° F. (800°–1100° C). Preferably, the alloy is annealed at about 1652°–1832° F. (900° C.–1000° C.), although material that exhibits a fine grain size is preferably annealed at about 1832° F. (1000° C.) or higher. Cooling from the annealing temperature is preferably at a rate slow enough to avoid excessive residual stress, but rapid enough to minimize precipitation of deleterious phases such as carbides in the annealed article. If desired, annealing can be carried out in an oxidation-retarding atmosphere such as dry hydrogen, dry forming gas (e.g., 85% $N_2$, 15% $H_2$), or in a vacuum.

When necessary after the alloy has been subjected to a minor amount of cold forming or other cold mechanical processing, e.g., straightening, the alloy is stress relieved at about 1472°–1652° F. (800°–900° C.). Heating the alloy in that temperature range produces a structure having relatively few, agglomerated carbides and/or nitrides. Such precipitates stabilize the carbon and nitrogen in the alloy, thereby reducing the likelihood of further precipitation of carbides and/or nitrides if the alloy is subjected to subsequent heat treating at a relatively lower temperature, for example, about 1292° F. (700° C.).

A combination of heat treatments may be used to optimize magnetic properties. For example, fine-grained material can be heated to about 1950° F. (1065° C.) to enlarge the grains. Then the alloy can be reheated to about 1562° F. (850° C.) to allow some of the carbon and nitrogen to re-precipitate. Such heat treatments minimize the precipitation of fine carbides and nitrides which can adversely affect the alloy's magnetic properties. As noted previously, such processing also inhibits the precipitation of fine carbides and/or nitrides if the alloy is subsequently heat treated at a relatively lower temperature.

The alloy according to the present invention can be used in a wide variety of product forms including billet, bar, and rod. The alloy is suitable for use in components such as magnetic cores, end plugs, and housings used in solenoid valves and the like which are exposed to chloride-containing fluids. The alloy is also suitable for use in components for fuel injection systems and antilock braking systems for automobiles.

The alloy in accordance with the present invention provides a unique combination of electrical, magnetic, and corrosion resistance properties. In particular, the present alloy provides a coercive force ($H_c$) of not more than about 5 Oe (398 A/m) in the annealed condition. The preferred compositions are capable of providing a coercive force not greater than about 3.5 Oe (279 A/m), or optimally, less than about 3.0 Oe (239 A/m) in the annealed condition. This alloy is also capable of providing a saturation induction ($B_{sat}$) in excess of 10 kG (1 T) and the preferred compositions provide a saturation induction of at least about 14 kG (1.4 T). Further, the present alloy provides an electrical resistivity of at least about 60 μΩ-cm. The corrosion resistance properties of the present alloy are demonstrated by the Examples which follow.

EXAMPLES

Examples 1–3 of the alloy of the present invention having the weight percent compositions shown in Table 1 were prepared to demonstrate the unique combination of corrosion resistance properties provided by this alloy. Alloys A–G outside the claimed range, having the weight percent compositions also shown in Table 1, were provided as a basis for comparison. Alloy F is representative of AISI Type 430FR alloy and Alloy G is representative of a ferritic stainless steel alloy sold under the designation "SANDVIK 1802", by Sandvik AB of Sweden.

TABLE 1

| | ALLOY NO. | | | | | | | | | |
|---|---|---|---|---|---|---|---|---|---|---|
| | 1 | 2 | 3 | A | B | C | D | E | F | G |
| C | 0.017 | 0.019 | 0.018 | 0.019 | 0.018 | 0.019 | 0.019 | 0.019 | 0.035 | 0.019 |
| Mn | 0.34 | 0.35 | 0.34 | 0.35 | 0.35 | 0.35 | 0.35 | 0.34 | 0.44 | 0.42 |
| Si | 0.89 | 0.89 | 0.87 | 0.90 | 0.89 | 0.88 | 0.87 | 0.89 | 1.21 | 0.44 |
| P | 0.019 | 0.019 | 0.019 | 0.021 | 0.022 | 0.020 | 0.020 | 0.019 | 0.020 | 0.019 |
| S | 0.29 | 0.29 | 0.29 | 0.31 | 0.31 | 0.30 | 0.29 | 0.30 | 0.30 | 0.27 |
| Cr | 17.60 | 17.60 | 17.57 | 17.57 | 17.55 | 17.62 | 17.65 | 17.57 | 17.61 | 17.38 |
| Ni | 0.20 | 0.20 | 0.20 | 0.21 | 0.21 | 0.20 | 0.21 | 0.20 | 0.20 | 0.20 |
| Mo | 0.94 | 1.49 | 2.09 | 0.31 | 1.00 | 1.49 | 2.09 | 0.31 | 0.33 | 2.07 |
| Ti | NA | <0.01 | <0.01 | NA | NA | NA | NA | NA | 0.01 | 0.51 |
| Nb | 0.34 | 0.34 | 0.34 | <0.01 | <0.01 | <0.01 | <0.01 | 0.34 | <0.01 | NA |
| N | 0.030 | 0.029 | 0.029 | 0.028 | 0.028 | 0.030 | 0.030 | 0.029 | 0.040 | 0.0088 |
| Fe | Bal. | Bal. | Bal. | Bal. | Bal. | Bal. | Bal. | Bal. | Bal. | Bal. |

NA = Not analyzed. No intentional addition.

Examples 1–3 and A–G were induction melted under argon gas as five (5) 30 lb (13.6 kg) heats and split cast into ten (10) 2.75 in (6.99 cm) square ingots. After solidification, the ingots were forged from a temperature of 2000° F. (1093° C.)[1] into (a) 1 in (2.54 cm) square bars and (b) 2.50 in×0.875 in (6.35 cm×2.22 cm) slabs. The latter were hot rolled from 2000° F. (1093° C.) to 0.125 in (3.175 mm) thick strips. The bars and strips were annealed at 1508° F. (820° C.) for 2 h, furnace cooled at about 44° F./h (24.4° C./h) to 1112° F. (600° C.), and then cooled in air.

[1] This forging temperature is slightly higher than the preferred hot-working temperature range for the alloy because of the higher than normal heat loss experienced by a small laboratory-sized ingot during forging.

Duplicate test samples measuring 1 in×2 in×0.125 in (2.54 cm×5.08 cm×0.32 cm), for critical crevice temperature (CCT) testing were machined from each of the annealed strips and ground by hand to a 120 grit finish. Standard CCT test assemblies were prepared as described in ASTM standard test procedure G48. The test assemblies were exposed to a solution of 5% $FeCl_3$+1% $NaNO_3$ for 24 h intervals at progressively higher temperatures. The starting temperature was 32° F. (0° C.) and the temperature increment between test intervals was 9° F. (5° C.). The results of the CCT testing of Alloys 1–3 and A–G are shown in Table 2 together with the %Mo and %Nb for each alloy for ease of comparison.

TABLE 2

| | | | Critical Crevice Temp. | |
|---|---|---|---|---|
| Alloy | % Mo | % Nb | °C. | °F. |
| 1 | 0.94 | 0.34 | 20/20 | 68/68 |
| 2 | 1.49 | 0.34 | 35/30 | 95/86 |
| 3 | 2.09 | 0.34 | 30/30[b] | 86/86[b] |
| A | 0.31 | <0.01 | 10/15 | 50/59 |
| B | 1.00 | <0.01 | 15/15 | 59/59 |
| C | 1.49 | <0.01 | 15/20[a] | 59/68[a] |
| D | 2.09 | <0.01 | 15[a]/15[a] | 59[a]/59[a] |
| E | 0.31 | 0.34 | 5/15[a] | 41/59[a] |
| F | 0.33 | <0.01 | 5/5 | 41/41 |
| G | 2.07 | NA | 30/30 | 86/86 |

[a]Possible attack or etch in crevice 5 C. (9 F.) below indicated critical crevice temperature.
[b]Possible pits in crevice at 20 C. (68 F.).
NA = Not analyzed. No intentional addition.

The data in Table 2 show that Alloys 1–3 have CCT's that are significantly higher than Alloys A–F, and similar to Alloy G.

Lengths of the annealed 0.125 in (0.32 cm) strips were shot-blasted and then pickled in a $HNO_3$-HF solution. The strips were cold rolled to 0.075 in (1.905 mm) thick, stress relieved by heating at 1346° F. (730° C.) for 4 h, cooled in air, and then cold rolled to 0.040 in (1.016 mm) thick. The strips were then annealed at 1508° F. (820° C.) for 2 h, furnace cooled at a rate of about 44° F./h (24.4° C./h), air cooled, then shot blasted and pickled again. Duplicate segments of each strip were autogenously welded together, edge-to-edge. Additional duplicate segments of each strip were butt-welded to strip segments of AISI Type 304 stainless steel alloy without using filler metal. All of the weldments were examined visually at a magnification of 20× and no cracks were observed in any of the weldments. The weldments were then tested for ductility using the Erichsen Cup Test. The results of the Erichsen cup testing are shown in Table 3 including the cup height in mm at the face and root of each weld, and an indication of any cracking of each ferritic/ferritic weldment (Ferritic Only) and each ferritic/Type 304 weldment (Ferritic/Type 304) resulting from the test.

TABLE 3

| | | | Cup Height (mm) | | | |
|---|---|---|---|---|---|---|
| | | | Ferritic Only | | Ferritic Type 304 | |
| Alloy | % Mo | % Nb | Face | Root | Face | Root |
| 1 | 0.94 | 0.34 | 5.14 T | 4.37 T | 8.55 L | 8.46 L |
| | | | 5.27 T/C | 4.47 T | 9.13 I/L | 9.28 L |
| 2 | 1.49 | 0.34 | 4.47 T | 5.28 T | 7.89 I | 7.93 I/L |
| | | | 4.68 T | 5.34 T | 8.63 L | 8.52 T/L |
| 3 | 2.09 | 0.34 | 3.97 T | 4.97 T | 8.60 L | 7.84 I |
| | | | 5.59 T | 5.29 T | 9.38 I/L | 8.58 L |
| A | 0.31 | <0.01 | 2.41 C/T | 3.08 T | 2.66 T | 5.56 D/L |
| | | | 3.56 T | 4.00 T | 5.72 L | 5.82 L |
| B | 1.00 | <0.01 | 2.47 C/T | 3.73 T | 4.72 T | 6.52 T |
| | | | 4:21 T | 4.07 T | 7.06 T | 7.34 T |
| C | 1.49 | <0.01 | 3.45 T | 2.17 T | 8.71 I | 8.49 L |
| | | | 3.84 T | 3.43 T | 8.76 I | 8.53 L |
| D | 2.09 | <0.01 | 2.21 C | 3.45 T | 7.82 T | 7.87 L |
| | | | 2.86 C/T | 3.49 T | 8.60 L | 8.66 L |
| E | 0.31 | 0.34 | 2.17 C/T | 5.66 T | 7.61 T | 8.49 L |
| | | | 4.36 T | 5.84 T | 8.57 T | 8.51 L |
| F | 0.33 | <0.01 | 2.14 T/C/D | 5.32 T/D/I | 8.31 L | 7.54 L |
| | | | 2.32 T/C/D | 4.01 T | — | 7.89 L |
| G | 2.07 | NA | 6.17 T | 6.46 T | 5.33 C/T | 6.47 T |
| | | | 2.32 T/C/D | 4.01 T | 8.36 T | 10.02 Tp |

T = Transverse crack in weld.
D = Diagonal crack in weld.
C = Centerline crack in weld.
I = Crack at weld-parent interface.
Tp = Transverse crack in ferritic parent metal.
L = Longitudinal crack in parent or heat affected zone of ferritic stainless steel.
NA = Not analyzed. No intentional addition.

The data of Table 3 show that the weldments of Alloys 1–3 have surprisingly good ductility which is generally better than that of the weldments of Alloys A–G. It is noted that the weldments of Alloy G provided very inconsistent results.

Duplicate corrosion testing coupons measuring 2.5 in×1.75 in×0.040 in (6.35 cm×4.45 cm×1.02 mm) were cut from the ferritic alloy/Type 304 stainless steel weldments for salt spray testing. The duplicate coupons of each alloy were tested in a salt spray of NaCl at 95° F. (35° C.) in accordance with ASTM standard test procedure B117 for 8 h. The results of the salt spray test are shown in Table 4 as indications of the existence and location of any rust observed on the respective coupons (Rusting).

TABLE 4

| | | | Rusting | |
|---|---|---|---|---|
| Alloy | % Mo | % Nb | Face Side | Root Side |
| 1 | 0.94 | 0.34 | None | None |
| 2 | 1.49 | 0.34 | None | None |
| 3 | 2.09 | 0.34 | None | None |
| A | 0.31 | <0.01 | Weld/Alloy A intf.* | Weld/ Alloy A intf.* |
| B | 1.00 | <0.01 | Weld/Alloy B intf.* | Weld/ Alloy B intf.* |
| C | 1.49 | <0.01 | Weld/Alloy C intf.* | Weld/ Alloy C intf.* |

TABLE 4-continued

| | | | Rusting | |
|---|---|---|---|---|
| Alloy | % Mo | % Nb | Face Side | Root Side |
| D | 2.09 | <0.01 | Weld and Weld/Alloy D intf.* | Weld and weld/Alloy D intf.* |
| E | 0.31 | 0.34 | Weld | None |
| F | 0.33 | <0.01 | Weld/Alloy F intf.* | Weld/ Alloy F intf.* |
| G | 2.07 | NA | None | None |

*intf. = interface
NA = Not analyzed. No intentional addition.

The data of Table 4 shows that only Alloys 1–3 and Alloy G did not rust in the salt spray test.

Eight (8) test cones (0.75 in (1.91 cm) base diameter, 60° apex angle) were machined from the annealed 1 in (2.54 cm) square bars of each alloy for salt spray testing. The test cones were ultrasonically cleaned and four (4) of the cones of each alloy were passivated as follows to remove any free iron particles present on the cone surfaces: (a) immersed in a solution of 5% NaOH at 160°–180° F. (71.1°–82.2° C.) for 30 min, (b) rinsed in water, (c) immersed in a solution of 20 vol. % nitric acid and 22 g/l sodium dichromate at 120°–140° F. (48.9°–60° C.) for 30 min, (d) rinsed in water, (e) immersed in a solution of 5% NaOH at 160°–180° F. (71.1°–82.2° C.) for 30 min, and then (f) rinsed in water.

The passivated and unpassivated test cones of each alloy were exposed to a salt spray of 5% NaCl at 95° F. (53° C.) in accordance with ASTM standard test procedure B117 for 200 h. After salt spray exposure, each cone was visually examined at a magnification of 10×. The results of the salt spray testing are shown in Table 5 as the number of cones of each alloy with any observed indication of surface penetration by pitting (No. of Specimens Pitted).

TABLE 5

| | | | No. of Specimens Pitted | |
|---|---|---|---|---|
| Alloy | % Mo | % Nb | Unpassivated | Passivated |
| 1 | 0.94 | 0.34 | 3 | 2 |
| 2 | 1.49 | 0.34 | 1 | 1 |
| 3 | 2.09 | 0.34 | 2 | 0 |
| A | 0.31 | <0.01 | 4 | 3 |
| B | 1.00 | <0.01 | 4 | 3 |
| C | 1.49 | <0.01 | 4 | 3 |
| D | 2.09 | <0.01 | 3 | 3 |
| E | 0.31 | 0.34 | 3 | 1 |
| F | 0.33 | <0.01 | 4[a] | 4[a] |
| G | 2.07 | NA | 4[b] | 1[c] |

[a]Four with large pits.
[b]One with large pits.
[c]Large pits.
NA = Not analyzed. No intentional addition.

The data of Table 5 shows that Alloys 2 and 3 provided superior resistance to pitting in the salt spray test compared to the other alloys. Although only one of the passivated specimens of Alloy G had any observed pitting, the pits were large, indicating a relatively more severe attack.

Eight (8) cylindrical test specimens 0.4 in (1.02 cm) diameter×0.75 in (1.91 cm) long were cut from the remainder of the annealed 1 in (2.54 cm) square bars of each heat for simulated service testing. The test cylinders were ultrasonically cleaned and four (4) of the cylinders of each alloy were passivated as described above. Duplicate passivated and unpassivated specimens were subjected to crevice corrosion testing in (a) tap water at 160° F. (71.1° C.) and (b) a 95% relative humidity atmosphere at 95° F. (35° C.). In both cases the exposure was carried out for 28 days. The crevice was formed by a No. 110 O-ring around the middle of each specimen. At the end of the exposures, the O-rings were removed and each cylinder was visually examined at a magnification of 20× for indications of corrosion in the crevice area. The results of the crevice corrosion testing in the tap water are shown in Table 6A and the results of the crevice corrosion testing in the 95% relative humidity atmosphere are shown in Table 6B. In both tables the results are presented as a qualitative evaluation of any observed indications of corrosion (Crevice Corrosion Observed).

TABLE 6A

| | | | Specimen | Crevice Corrosion Observed | |
|---|---|---|---|---|---|
| Alloy | % Mo | % Nb | ID | Unpassivated | Passivated |
| 1 | 0.94 | 0.34 | a | Stain; lt. etch | Stain, lt. etch |
| | | | b | Stain | Crevice OK |
| 2 | 1.49 | 0.34 | a | Lt. stain | Lt. stain; lt. etch |
| | | | b | Stain; lt. etch | Stain; lt. etch |
| 3 | 2.09 | 0.34 | a | Crevice OK | Crevice OK |
| | | | b | Crevice OK | Stain; lt. etch |
| A | 0.31 | <0.01 | a | Stain; lt. etch | Lt. stain; lt. etch |
| | | | b | Stain; lt. etch | Stain; lt. etch |
| B | 1.00 | <0.01 | a | Stain; lt. etch | Stain |
| | | | b | Stain; lt. etch | Stain; lt. etch |
| C | 1.49 | <0.01 | a | Stain; lt. etch | Stain; lt. etch |
| | | | b | Lt. stain | Lt. stain; lt. etch |
| D | 2.09 | <0.01 | a | Lt. stain | Lt. stain; lt. etch |
| | | | b | Lt. stain | Lt. stain |
| E | 0.31 | 0.34 | a | Lt. stain | Stain; lt. etch |
| | | | b | Lt. stain | Lt. stain |
| F | 0.33 | <0.01 | a | Crevice OK | Stain; lt. etch |
| | | | b | Lt. stain | Stain; lt. etch |
| G | 2.07 | — | a | Lt. stain; lt. etch | Stain; lt. etch |
| | | | b | Stain; lt. etch | Stain; lt. etch |

TABLE 6B

| | | | Specimen | Crevice Corrosion Observed | |
|---|---|---|---|---|---|
| Alloy | % Mo | % Nb | ID | Unpassivated | Passivated |
| 1 | 0.94 | 0.34 | a | Possibly rust spot | Possibly small pit |
| | | | b | Crevice OK | Crevice OK |
| 2 | 1.49 | 0.34 | a | Crevice OK | Crevice OK |
| | | | b | Crevice OK | Crevice OK |
| 3 | .2.09 | 0.34 | a | Possibly lt. etch | Crevice OK |
| | | | b | Crevice OK | Crevice OK |
| A | 0.31 | <0.01 | a | Crevice OK | Crevice OK |
| | | | b | Crevice OK | Etch; pits |
| B | 1.00 | <0.01 | a | Crevice OK | Crevice OK |
| | | | b | Possibly 1 pit | Possibly lt. attack |
| C | 1.49 | <0.01 | a | Crevice OK | Crevice OK |
| | | | b | Crevice OK | Crevice OK |

TABLE 6B-continued

| Alloy | % Mo | % Nb | Specimen ID | Crevice Corrosion Observed Unpassivated | Passivated |
|---|---|---|---|---|---|
| D | 2.09 | <0.01 | a | Crevice OK | Crevice OK |
| | | | b | Crevice OK | Crevice OK |
| E | 0.31 | 0.34 | a | Crevice OK | Lt. stain |
| | | | b | Possibly lt. etch | Possibly lt. etch |
| F | 0.33 | <0.01 | a | Lt. etch;bottom att[1] | Crevice OK |
| | | | b | Etch; lt. attack | Crevice OK |
| G | 2.07 | — | a | Possibly rust spot | Crevice OK |
| | | | b | Crevice OK | Crevice OK |

[1]Attack on bottom at crevice where specimen rested on support.

The data in Table 6A shows that Alloy 3 provided the best overall corrosion resistance in the tap water test. However, the data in Table 6B suggests that the 95% relative humidity test does not provide an adequate basis for distinguishing between the various materials tested.

The terms and expressions which have been employed are used as terms of description and not of limitation. There is no intention in the use of such terms and expressions of excluding any equivalents of the features shown and described or portions thereof. It is recognized, however, that various modifications are possible within the scope of the invention as claimed.

What is claimed is:

1. A free-machining, corrosion resistant, ferritic steel alloy consisting essentially of, in weight percent, about:

| | |
|---|---|
| C | 0.05 max. |
| Mn | 0.1–2.0 |
| Si | 0.70–1.5 |
| P | 0.035 max. |
| S | 0.1–0.5 |
| Cr | 15–20 |
| Mo | 1.00–3.00 |
| Ti | 0.02 max. |
| Al | 0.05 max. |
| Nb | 0.1–0.6 |
| Ni | 0.2–0.6 |
| Cu | 0.25 max. |
| N | 0.06 max. |

and the balance is essentially iron, wherein Cr, Mo, and Nb are balanced such that the alloy contains at least about 1.5% Mo when less than about 0.35% Nb and less than about 18% Cr are present, and the elements C, N, and Nb are balanced within their respective weight percent ranges such that the ratio, Nb/(C+N), is about 7–12.

2. An alloy as recited in claim 1 containing at least about 1.5% molybdenum.

3. An alloy as recited in claim 1 containing not more than about 2.50% molybdenum.

4. An alloy as recited in claim 1 containing at least about 0.90% silicon.

5. An alloy as recited in claim 1 containing at least about 1.00% silicon.

6. A free-machining, corrosion resistant, ferritic alloy consisting essentially of, in weight percent, about:

| | |
|---|---|
| C | 0.03 max. |
| Mn | 0.1–1.0 |
| Si | 0.8–1.4 |
| P | 0.025 max. |
| S | 0.2–0.4 |
| Cr | 16–19 |
| Mo | 1.00–2.50 |
| Ti | 0.02 max. |
| Al | 0.05 max. |
| Nb | 0.20–0.60 |
| Ni | 0.2–0.6 |
| Cu | 0.25 max. |
| N | 0.05 max. |

and the balance is essentially iron, wherein the elements Cr, Mo, and Nb are balanced such that the alloy contains at least about 1.5% Mo when less than about 0.35% Nb and less than about 18% Cr are present, and C, N, and Nb are balanced within their respective weight percent ranges such that the ratio, Nb/(C+N) is about 7–12.

7. An alloy as recited in claim 6 containing at least about 1.50% molybdenum.

8. An alloy as recited in claim 7, containing not more than about 2.00% molybdenum.

9. An alloy as recited in claim 6, containing at least about 1.00% silicon.

10. An alloy as recited in claim 9, containing not more than about 18% chromium.

11. A free-machining, corrosion resistant, ferritic alloy consisting essentially of, in weight percent, about:

| | |
|---|---|
| C | 0.020 max. |
| Mn | 0.2–0.6 |
| Si | 0.8–1.2 |
| P | 0.020 max. |
| S | 0.25–0.35 |
| Cr | 17–18 |
| Mo | 1.50–3.00 |
| Ti | 0.01 max. |
| Al | 0.05 max. |
| Nb | 0.20–0.60 |
| Ni | 0.2–0.4 |
| Cu | 0.15 max. |
| N | 0.030 max. |

and the balance is essentially iron, wherein the elements C, N, and Nb are balanced within their respective weight percent ranges such that the ratio, Nb/(C+N) is about 7–12.

12. An alloy as recited in claim 2 containing at least about 0.2% niobium.

* * * * *